US008944186B2

(12) United States Patent
Kočiš et al.

(10) Patent No.: US 8,944,186 B2
(45) Date of Patent: Feb. 3, 2015

(54) DEVICE FOR PERFORMING DEEP DRILLINGS AND METHOD OF PERFORMING DEEP DRILLINGS

(75) Inventors: Igor Kočiš, Bratislava (SK); Ivan Kočiš, Bratislava (SK); Tomáš Krištofič, Bratislava (SK); Dušan Kočiš, Bratislava (SK)

(73) Assignee: GA Drilling, A.S. (SK)

( * ) Notice: Subject to any disclaimer, the term of this patent is extended or adjusted under 35 U.S.C. 154(b) by 639 days.

(21) Appl. No.: 13/148,032

(22) PCT Filed: Feb. 3, 2010

(86) PCT No.: PCT/SK2010/050002

§ 371 (c)(1),
(2), (4) Date: Aug. 4, 2011

(87) PCT Pub. No.: WO2010/090609

PCT Pub. Date: Aug. 12, 2010

(65) Prior Publication Data

US 2011/0290563 A1 Dec. 1, 2011

(30) Foreign Application Priority Data

Feb. 5, 2009 (SK) ..... 5011-2009

(51) Int. Cl.
*E21B 7/00* (2006.01)
*E21B 7/14* (2006.01)
(Continued)

(52) U.S. Cl.
CPC ... *E21B 7/14* (2013.01); *E21B 7/15* (2013.01); *E21B 7/18* (2013.01)
USPC ..... 175/171; 166/287; 166/177.4

(58) Field of Classification Search
USPC ..... 175/171, 207, 217; 166/287, 290, 177.4
See application file for complete search history.

(56) References Cited

U.S. PATENT DOCUMENTS 3,788,703 A 1/1974 Thorpe
4,254,828 A 3/1981 Sowa et al.
(Continued)

FOREIGN PATENT DOCUMENTS

WO 9603566 A2 2/1996
WO 03/069110 A1 8/2003
(Continued)

OTHER PUBLICATIONS

John Kennedy, Anaconda drilling system nears commercial rollout (Halliburton Energy Services), Drilling Contractor, Jul./Aug. 2000 (2 pages).
(Continued)

*Primary Examiner* — Kenneth L Thompson
*Assistant Examiner* — Ronald Runyan
(74) *Attorney, Agent, or Firm* — Hovey Williams LLP

(57) ABSTRACT

Device for performing deep drillings, especially geothermal, may include a surface base, a borehole in a geological formation, filled with fluid, and a robotic multi-functional underground drilling platform, which contains especially a block (2) for crushing rock (1), a block for continuous formation of casing profile, a block of casing as transfer and transport infrastructure, a block (16) of transport container, a control and communication block (39), an energy block (4), a block of operating transport containers, and a block of removing and loading rock (1) from the place of crushing. The block (2) for rock crushing may be interconnected with block of removing and loading rock (1) from the place of crushing by means of water channels, ensuring removal of the crushed rock—107—. The block of removing and loading rock (1) from the place of crushing may be interconnected with block (16) of transport container by means of water channels. The block of casing as transfer and transport infrastructure may be connected to block of continuous forming the casing profile by means of moving formworks.

18 Claims, 12 Drawing Sheets

(51) Int. Cl.
*E21B 7/15* (2006.01)
*E21B 7/18* (2006.01)

(56) References Cited

U.S. PATENT DOCUMENTS

| | | | |
|---|---|---|---|
| 4,422,801 | A | 12/1983 | Hale et al. |
| 4,741,405 | A | 5/1988 | Moeny et al. |
| 5,107,936 | A | 4/1992 | Foppe |
| 5,168,940 | A | 12/1992 | Foppe |
| 5,286,462 | A | 2/1994 | Olson |
| 5,291,957 | A | 3/1994 | Curlett |
| 5,425,570 | A | 6/1995 | Wilkinson |
| 5,771,984 | A | 6/1998 | Potter et al. |
| 6,591,920 | B1 | 7/2003 | Foppe |
| 6,684,801 | B1 | 2/2004 | Kuklinski |
| 6,739,392 | B2 | 5/2004 | Cook et al. |
| 6,761,416 | B2 | 7/2004 | Moeny |
| 6,870,128 | B2 | 3/2005 | Kobayashi et al. |
| 6,935,702 | B2 | 8/2005 | Okazaki et al. |
| 6,962,121 | B1 | 11/2005 | Kuklinski |
| 7,017,681 | B2 | 3/2006 | Ivannikov et al. |
| 7,416,258 | B2 | 8/2008 | Reed et al. |
| 7,487,834 | B2 | 2/2009 | Reed et al. |
| 2010/0031653 | A1 | 2/2010 | Foppe |

FOREIGN PATENT DOCUMENTS

| | | | |
|---|---|---|---|
| WO | 2007/122003 | A1 | 11/2007 |
| WO | 2008/144096 | A1 | 11/2008 |
| WO | 2009/005479 | A1 | 1/2009 |

OTHER PUBLICATIONS

Tesco Corporation, Bulletin 3000e, Tesco Casing Drilling—Reach your reservoir with more efficiency and flexibility—Better Ways to the Bottom, © Apr. 2008 Tesco Corporation (12 pages).

E. Jerby, O. Aktushev, and V. Dikhtyar, Theoretical analysis of the microwave-drill near-field localized heating effect, Journal of Applied Physics 97, 034909 (2004), published online Jan. 18, 2005 (7 pages).

DEVICE FOR PERFORMING DEEP DRILLINGS AND METHOD OF PERFORMING DEEP DRILLINGS

This is a national stage application under 35 U.S.C. 371 et. seq. of International Application PCT/SK2010/050002 filed 3 Feb. 2010 and claiming priority to and the benefit of Slovak Republic Application No. 5011-2009 filed 5 Feb. 2009, the entire disclosures of which are incorporated herein by reference.

TECHNICAL FIELD

The invention relates to a system for performing deep drillings, and in particular geothermal deep drillings. The system is intended for underground work in geological formations and is adapted especially for working in depths of up to 10 km and more, at a pressure of up to 1000 bar and more, and at a temperature of adjacent rock up to 400° C. The invention also relates to a method of performing deep drillings.

BACKGROUND OF THE INVENTION

At present, oil and gas extraction and geological and geothermal probing are carried out by drilling rigs, where disintegration of the rock is performed by rotating drilling heads. The drilling heads are secured at the end of assemblies of connected basic pipes, and the drilling heads are rotated at the surface by driving units. The disintegrated rock is transported to the surface by a special liquid, circulating in the piping and in the borehole formed by the drilling heads. In the past, turbine driving units have been used near the drilling head wherein the energy is supplied from the surface by an aqueous carrier, which also flushes the crushed rock from the system. Energy has also been supplied by electrical cable. Nevertheless, the transport of the disintegrated rock is performed in both systems by classical method—using a viscous circulating liquid.

Especially in the last decade, new methods of more efficient performing of rock disintegration and of its transport to the surface have been searched for.

The study of MIT (USA) "The Future of Geothermal Energy"—Impact of Enhanced Geothermal Systems (EGS) on the United States in the 21st Century 2006-points to the crucial importance of developing economically efficient technology of drilling deep geothermal boreholes. The price of the borehole increases exponentially with depth when using present drilling technologies. Therefore, there exists an urgent need to find drilling technology for which the price of the borehole would increase approximately linearly with the borehole depth.

A coauthor of the above study, Jefferson Tester, characterizes in his presentation requirements for a new, quick, and ultradeep drilling technology as follows:

- the drilling price increases linearly with the depth
- neutrally flowing drilling axis
- ability to drill vertically or at an angle to depths of over 20 km
- ability to drill large diameters up to five times larger than at the surface
- casing is formed inside the borehole.

Over twenty innovative technologies of drilling in geological formations of various sophistication are known.

From the state of the art we shall describe only the most promising technologies or those that have already been examined.

Overview of Present Technologies:

The technologies may be evaluated also according to such properties as specific energy necessary for an extracted cubic centimeter, the maximum possible performance at the borehole bottom, and maximum available drilling speed.

From this point of view, the most important role is played by mechanical principles such as electro-spark discharges in water and water beam cutting.

Among available solutions, which are not yet completely viable for deep geothermal conditions, there may be included the following examples:

- technologies of drilling by means of rotary casing (TESCO CASING DRILLING), which eliminates one system of pipes but does not alleviate the substantial negatives of mechanical drilling; and
- technology of coil composite piping with electric power transmission line for driving of drilling at the bottom of the borehole (HALLIBURTON/STATOIL-ANACONDA), which eliminates the rotating element of the drilling pipe for transmission of mechanical energy but does not solve the issue of flushing the crushed rock from the system.

Considerable progress in drilling technology is represented by the U.S. Pat. No. 5,771,984 of the authors Jefferson Tester et al., titled "Continuous Drilling of Vertical Boreholes by Thermal Processes: Rock Spallation And Fusion", where the energy to power the drilling rig at the bottom is delivered by power water, which flushes the borehole, drives the turbine, and produces electric energy for the actual process of drilling by thermal spallation or fusion of the rock. The invention of U.S. Pat. No. 5,771,984 is also the basis for the subject matter of the firm Potter Drilling LLC, the technologies of which are already in the state of prototype testing.

Related technologies are described in the U.S. Pat. No. 5,107,936 titled "Rock Melting Excavation Process". The author Werner Foppe describes a process by rock fusion on the circumference of the borehole, pressing the melt into the core and breaking of the core. The same author describes in the U.S. Pat. No. 6,591,920 fusion of the rock and its pressing into the surrounding rock.

Cutting the rock by a plasma beam is described in the U.S. Pat. No. 3,788,703 by Thorpe. Nevertheless, it does not solve removal of the crushed rock.

At the University in Tel Aviv, the authors Jerby et al.: JOURNAL OF APPLIED PHYSICS 97 (2004) solve the process of rock spallation by local overheating using microwaves.

The largest group of patents covers technology of cutting the rock by a water beam.

Described are variants of different modifications, for example utilization of cavitation, turbulent processes, combinations with other mechanical principles and the like. For example the U.S. Pat. No. 5,291,957 describes the process of using a water beam in combination with a turbulent and mechanical process.

In the last decade, intensive research of utilization of high-energy laser beams for rock disintegration is in progress. It concerns especially the conversion of military devices for disintegrating rock. The laser energy is used for the process of thermal spallation, fusion and evaporation of the rock.

The patent of Japanese authors Kobayashi et al., U.S. Pat. No. 6,870,128 titled "Laser Boring Method And System", describes laser drilling, where the light beam is fed from the surface through optical cable to the borehole bottom. This system evaporates the rock, which requires high consumption of energy.

The authors Zhiyue Xu et al. describe in the paper LASER SPALLATION OF ROCKS FOR OIL WELL DRILLING, published in the Proceedings of the 23rd International Congress on Applications of Lasers and Electro-Optics 2004, a method of thermal spallation, which is energetically more favorable, but removal of the crushed material is performed by classical flushing.

Methods of using electric discharge are based on long-term experience in other application areas. The method described in the U.S. Pat. No. 5,425,570 of the author G. Wilkinson is based on a combination of electric discharge with subsequent explosion of a small amount of an explosive or of an induced aluthermic process.

U.S. Pat. No. 4,741,405 and U.S. Pat. No. 6,761,416 of the author W. Moeny describe usage of multiple electrodes with high-voltage discharge in an aqueous environment, while removal of the crushed rock is performed by classical flushing.

An analogous method is described also in the U.S. Pat. No. 6,935,702 of the authors Okazaki et al. titled "Crushing Apparatus Electrode And Crushing Apparatus" with the usage of classical flushing.

The author A. F. Usov describes the use of electric discharge for drilling large diameters of over 1 m with the speed of up to several m/h, realized in the Scientific center Kola of Russian Academy of Sciences.

In the patent RU 2059436 C1 the author V. V. Maslov describes generating high voltage pulses for material destruction.

The authors Hirotoshi et al. describe in the paper Pulsed Electric Breakdown and Destruction of Granite, published in Jpn. J. Appl. Phys. Vol. 38 (1999) 6502-6505, successful usage of electric discharge on the typical geothermal rock-granite.

Rising of heavy undersea loads is described in the U.S. Pat. No. 4,422,801 titled "Buoyancy System For Large Scale Underwater Risers" of the authors Hale et al., where effective manipulations with large loads to over 3000 m depth are reached by variable buoyancy of ballast tanks.

In the U.S. Pat. No. 5,286,462 of the author J. Olson, there is described a system of quick gas generation for quick emptying ballast tanks for utilizing buoyancy for manipulating loads.

The problem of fast moving of an object in aqueous environment, which is a determining factor for transport effectiveness, is solved for military purposes in the U.S. Pat. No. 6,962,121 titled "Boiling Heat Transfer Torpedo" of the author R. Kuklinski and the U.S. Pat. No. 6,684,801 titled "Supercavitation Ventilation Control System". These describe the method of artificial supercavitation, in which it is possible with a properly shaped object to achieve a speed of several hundred meters per second in water.

An apparatus for deep stimulating at the borehole bottom is described in the U.S. Pat. No. 4,254,828 titled "Apparatus For Producing Fractures And Gaps In Geological Formations For Utilizing The Heat Of The Earth" of the authors Sowa et al., in which the importance of pressure generation at the borehole bottom by an autonomous energy system is described. Similarly, also in the U.S. Pat. No. 7,017,681 of the authors Ivannikov et al. is described an autonomous system of stimulation by hydrodynamic effects at the borehole bottom.

At present, the state of techniques for forming casings is represented by expandable casings of various kinds. For example, technology described by the authors R. Cook et al. in the U.S. Pat. No. 6,739,392 titled "Forming A Wellbore Casing While Simultaneously Drilling A Bore" uses a sequence of steps, where special piping lowered down without casing is expanded by a pressure medium.

From the point of view of continuous casing production, the present state of the art provides a convenient starting point, because there have already been developed and put in practice cement composite mixtures, which quickly set under water and form high-strength concrete, especially for military purposes. Such cement composite mixtures have been developed also for storing hazardous wastes.

Substantial progress compared to the current state of the art is represented by a solution in which the system of interlocking pipes has been removed and is now replaced by freely moving containers in a water environment of continuously constructed casing. This is described below.

In the patent application 5087-2007 titled "Device For Excavation Of Deep Holes In A Geological Formation And Method Of Energy And Material Transport In These Holes" of the authors I. Kociš et al., there is described an innovative solution of a drilling device, wherein the main innovations are the transportation of rock, the material for casing production, and the transfer of energy through openings in the casing. The casing is filled with water by means of autonomous transport modules or containers by utilizing gas buoyancy. With negative buoyancy the containers move downwards. Casing is continuously formed from a part of the extracted rock and material supplied from the surface. The device includes an underground base, a transport module, a surface base, and the borehole in the geological formation and filled with water. Nevertheless, this device does not sufficiently solve the movement of transport modules, continuous preparation of the casing profile, manipulation with transport modules in the underground base and in the surface base, and control of and communication with the components. The device as a whole creates conditions for nearly linear dependence of the price of the created borehole (well) on its depth/length.

Summary of Recent Technologies

However, most of these methods have not reached the goal of substantial cost reduction in performing a deep drilling, as there have been several factors acting simultaneously against it:

- problem of extracted material transport to the surface stayed unsolved without pipes connected in sequence one after the other,
- problem of casing and its "in situ" formation,
- problem of energy supply to the drilling device,
- problem of energy demand, the necessity to disintegrate the whole borehole volume to small particles or even to melt down or evaporate the whole volume.

Also the presence of a fluid (water, viscous transport fluid) in the borehole acts against the efficiency of these technologies. Energy supply has been solved, for example, by pressure water supply, electric energy supply via an electric cable, composite flushing line, or optical-fibre cables for high energy laser power supply. All mentioned technologies presume a certain steady, continually extended connection between the drilled ground and the surface. Similarly, also transport of the crushed rock still depends on the extending piping for transport media.

An equally important part of the borehole is the borehole wall casing made of gradually inserted pipes, which, moreover, narrow down with the borehole depth and so reduce the overall throughput and contribute to excessively rising price in dependence on the borehole depth. Recently, expandable casing with the same diameter in the whole borehole has been developed, but this only partially solves the problem of exponential price of the borehole.

None of the drilling technologies described so far has brought any innovation, which would substantially change the efficiency of the whole drilling process and the efficiency of the crushed rock transport to the surface, and which would guarantee drilling to large depths (over 5 km) and, simultaneously, guarantee approximately linear price dependence. From this, it follows the need of such technology, which substantially solves disadvantages of the current state of the art in the following aspects:

transport of energy downwards to the drilling process, transport of the crushed rock to the surface so that direct continuous physical interconnection between the surface and the drilling device at the borehole bottom is disconnected in a way that is independent on the actual depth of the borehole, process of casing formation would be performed continuously and in parallel with the process of borehole formation, achievement of economical energy usage in crushing the rock and its transport to the surface, possibility of cutting the rock into blocks and of their transport to the surface, functionality of the device also at high pressures and temperatures in the borehole in the rock, with the borehole being flooded with fluid.

SUMMARY OF THE INVENTION

The above disadvantages are eliminated to a large extent by a system for performing deep drillings, the system containing a surface base, a borehole in geological formation filled with fluid, and a robotic multi-functional underground drilling platform, which contains the following schematic blocks or steps: mechanism (2) for crushing rock (1), continuous formation of the casing profile so as to form a transfer and transport infrastructure, transport container(s) (16), control and communication subsystem (39), energy subsystem (4), transport container operation, removing and loading rock (1) from the place of rock crushing, and a method of performing deep drillings, especially for performing geothermal deep drillings according to the present invention, the system and method characterized (as illustrated in FIG. 12) by the following schematic relations:

crushing is interconnected with the removing and loading the rock from the place of crushing by means of water channels, ensuring removal of the crushed rock;

removing and loading the rock from the place of crushing is interconnected with the transport containers by means of water channels;

the transfer and transport infrastructure is created via continuous formation of the casing profile by means of moving formworks;

operating transport containers is interconnected to transport containers by means of operating mechanics;

removing and loading the rock from the place of crushing is interconnected with operating transport containers by means of water channels;

operating transport containers is interconnected with the transport containers by means of water channels;

the transport containers are interconnected with the continuous formation of the casing profile by means of injection channels;

the transport containers are interconnected with the casing transfer and transport infrastructure by means of water channels;

the control and communication subsystem is connected to other aspects by sensory channels and channels of control signals; and the energy subsystem is interconnected with other aspects by energetic channels.

To increase the system efficiency, the robotic multi-functional underground drilling platform can be further enhanced with at least one of the following schematic subsystems or steps:

a) moving and directing the platform, b) fine moving the crushing block, c) connecting to the container of cement composite mixture, d) containers injection at the surface, e) containers ejection at the surface, f) braking device for slowing down a container in the transport piping, characterized by quick braking of the transport container block in the transport piping, g) sealing against the surrounding rock, and h) protection against vibrations and pressure waves.

Continuous formation of a casing profile preferably comprises a formwork bottom, a formwork curved piece, a flexible connection, bottom of formwork cement composite mixture, space for casing forming, connection with the container of cement composite mixture, and an elastic connection of curved pieces.

Transfer and transport infrastructure preferably comprises transport piping, casing of cement composite mixture, service piping, a channel for transmitting service signals, energy, and service water, fuel supply piping, moving formwork of the fuel supply, labyrinth sealing, a moving elastic seal, a fuel inlet leading into the fuel supply piping, a fuel supply system at the surface, and an underground fuel supply system connection. The casing is in a part, preferably in a lower, deeper part, made of cement composite mixture with considerably higher thermal conductivity than in the upper part, and the formwork for moving the fuel supply contains a sealing between the fuel supply formwork and the formed casing.

Operating transport containers preferably comprises a braking and manipulation platform, a rotary actuator, a braking device, a braking cylinder, a braking piston, and a rotary platform.

Removing and loading the rock from the place of rock crushing preferably comprises circulating water for loading the rock, a flushing path, a system of flaps for flushing the rock out, a flushing channel, a flushing space, and a space for loading the rock.

The transport container is equipped with a braking device for braking the container at the borehole bottom for braking the container in the transport piping. A cyclone separator separates the crushed rock from the water for loading the crushed rock into the transport container. A hydraulic piston, pressure hydraulic medium, energy carrier and/or interface node is included for connection with the platform for transportation of the cement composite mixture or mixture of water with the rock.

The control and communication subsystem is preferably protected by a hermetic box resistant against high-pressure water. The box surface is able to dissipate heat from the control and communication subsystem into the environment such as into the surrounding circulating cooling water.

Sealing against the surrounding rock preferably includes an elastic torus, made of a textile based on metal fibers, Kevlar, carbon fibers, or a mixture thereof. The elastic torus is water pressurized.

Protection against vibrations and pressure waves is preferably formed by a covering containing granulate, a covering of a perforated metal plate, suitably shaped baffle areas, channels for leading away a pressure wave, partially open gas containers and the like, or any combination thereof.

The connection to the container of cement composite mixture preferably includes or contains at least one connection to a high-pressure hydraulic medium.

Container injection at the surface preferably includes a source of water such as from a decanting plant, a water pump, a flap system for container injection, a surge chamber for container injection, a flap system for releasing a container, and a water path over the container.

Exit (ejecting) of containers at the surface preferably includes an exit to a decanting plant, a system of grids, a damping structure, a flap system for catching a container, a surge chamber for container exit (ejection), a number of containers and/or material transporters.

The method of performing deep drillings, in particular geothermal deep drillings in geological formations, according to the present invention may include the following features:

a. regarding rock crushing, the rock is crushed and/or disintegrated by means of one or a combination of devices from a group of devices, which may include a directed explosion, an electro-spark discharge, a water beam, a plasma process, spallation by laser, spallation by plasma, by high-temperature fluid, mechanical drilling, and other rock crushing means, b. regarding the continuous formation of the casing profile, the container moving formwork fills the casing area against the surrounding rock with cement composition reinforced with metal fibers, carbon fibers, Kevlar fibers, or a mixture with various fiber lengths. The composition forms the casing after solidifying, and continuously forms the casing via the moving formwork. Interaction of the moving formwork with the formed casing continuously forms at least 2 openings, c. regarding the casing as transfer and transport infrastructure, which is formed continuously during the drilling process, two openings are made in which a two-way (one up and one down) water transport path for container transport from the surface to the bottom of the borehole and back, based on the forces of circulating water and/or based on the buoyancy applied to the container, either positive or negative, and based on the gas buoyancy (airlift). Further openings allow the cement composite mixture to be formed between the individual openings as reinforcement of the whole casing, the casing further containing further openings for transport of technological water for cooling and transport of water power. Additional openings are formed for transport of liquid or gaseous energy carriers, electric energy, and electric signals and the like. The casing as transfer and transport infrastructure also cooperates with other subsystems of the system according to point 1, d. transport container assures transportation of necessary materials such as the transportation of cement composite mixture to the casing and the transportation of crushed rock to the surface, etc., e. the control and communication subsystem performs telemetry, signaling, acquiring sensory information and evaluations and controls other processes and blocks of the platform, f. the energy subsystem transforms energy from a primary energy source to other energy forms for the other subsystems of the platform, g. operating transport containers ensures that the transport containers are in functional positions, h. regarding removing and loading the rock from the place of crushing, rock is removed and loaded hydrodynamically such as by water stream and/or gas stream.

To increase the effect of the method of performing deep drillings, the following procedures may be utilized:

a. fine moving the crushing block ensures a rate of transport of rock in dependence on the progress of rock crushing, b. regarding continuous formation of the casing profile, the casing is created with a cement composition that is lighter than water. The cement composition fills the moving formwork from a container, c. regarding casing as transfer and transport infrastructure, which through the openings and piping for transport of liquid or gaseous fuels, the piping is expanded at the bottom of the borehole, where a part of the formwork of these openings is provided for the transport and supply of fuels and oxidizers to places they are needed such as at the place of crushing rock, d. regarding operation of the transport containers, the separation of water and crushed rock, the injection of cement composition into the space for casing forming, and/or the connection with the platform for transportation of the cement composite mixture or water with rock mixture, operations are completed via a pressure hydraulic medium or energy carrier, e. the control and communication subsystem is cooled with a medium from the piping in the continuous casing and is connected with surface communication devices by means of conducting electric cables and/or in a wireless manner, f. the energy subsystem ensures conversion of energy from power sources such as power water supplied from above, electric energy fed by an electric cable through the casing piping, an autonomous source, energy of crushing explosion, hydraulic medium, and/or a solid or liquid energy carrier for use as driving power for the respective platform subsystems and other processes, g. the energy subsystem transforms the supplied electric low voltage energy to high voltage energy, and is protected by a hermetic box resistant against high pressure, h. regarding moving and directing the platform, directing and shifting the platform is ensured by actuators relative to surrounding rock in at least three points, and directing and shifting of rock crushing processes is done in cooperation with the control subsystem. The platform is moved at a rate dependent on the process of casing solidification and on the process of rock crushing. The movement is controlled by the control and communication subsystem in dependence on the particular platform processes, i. connection to the container for injection of the cement composite mixture, which forms the casing after solidification, ensures a connection for transfer of the mixture and at least one connection to high-pressure hydraulic medium for injecting the mixture, j. the braking device for braking a container in the transport piping is activated by a pressure change over and under the container, k. protection against vibrations and pressure waves relieves the effects of vibrations and/or pressure waves caused mainly by the block of rock crushing, l. injecting containers at the surface ensures entry of the containers into circulating transport water, m. ejection of containers at the surface ensures exit of the containers out of the circulating transport water, n. the crushed rock is separated from water by means of a cyclone separator for loading the crushed rock into the transport containers, o. the transport container injects the cement composite mixture into the block of continuous forming of the casing profile by means of a hydraulic piston, p. sealing against the surrounding rock ensures watertight separation of the continuous forming of the casing profile from the surrounding rock, r. operating transport containers ensures exit of containers from the circulating water at the borehole bottom, injection of containers into the circulating water, braking of containers exiting from the circulating water, and starting-up of containers entering the circulating water.

The nature of the invention consists mainly in an innovative method of drilling deep boreholes with high economic efficiency at nearly the same price per unit of the borehole depth up to 10 km with preservation of the same constant borehole diameter. The stated technical result is achieved via a robotic multi-functional platform working at the depth of the borehole at the place of rock crushing. The above subsystems and subcomponents cooperatively ensure necessary activities for effective rock crushing, flushing out and removing the rock from the place/depth of drilling, loading the rock into the transport container, transporting the rock to the surface, continuous forming of the casing, transport of the cement composition downward from the surface, manipulation of containers, shifting and directing the platform, control of the process of drilling and communication with the surface, feeding electric energy by means of a cable from the surface, transformation of this energy to the required energy form, as well as auxiliary functions of sealing against surrounding rock, connecting with the container of cement composite mixture transport, and protection against pressure waves during detonation crushing of the rock.

The underground robotic platform, realizing the above features and activities, eliminates disadvantages of the prior state of the art and enables continuous drilling process without the shortcomings of classical methods of drilling.

Innovation in the Technical Solution

Innovation in the technical solution is formed by modular robotic platform with the following functionalities:

transport of material by specialized containers in circulating aqueous medium continuous forming of casing by cement composition, which creates a easing profile having least two openings, cooling of the environment of the underground platform by circulating transport water, operation of electronics and electrical circuits in protection boxes resistant against high pressure and cooled by circulating water, removing and loading the crushed rock via a hydrodynamic method of circulating water, moving the platform and directing the platform drilling, using of special cement and/or polymeric mixture lighter than water to form the casing, crushing of the rock by several physical processes without change of the overall structure of the platform and material transport, autonomous robotic platform operation, feeding of liquid or gaseous media and fuels, via several openings in the casing, sealing against the rock in the form of an elastic torus pressurized with water, the continuously formed casing being the transport infrastructure for the platform.

DETAILED DESCRIPTION OF THE DRAWINGS

Figure 1:
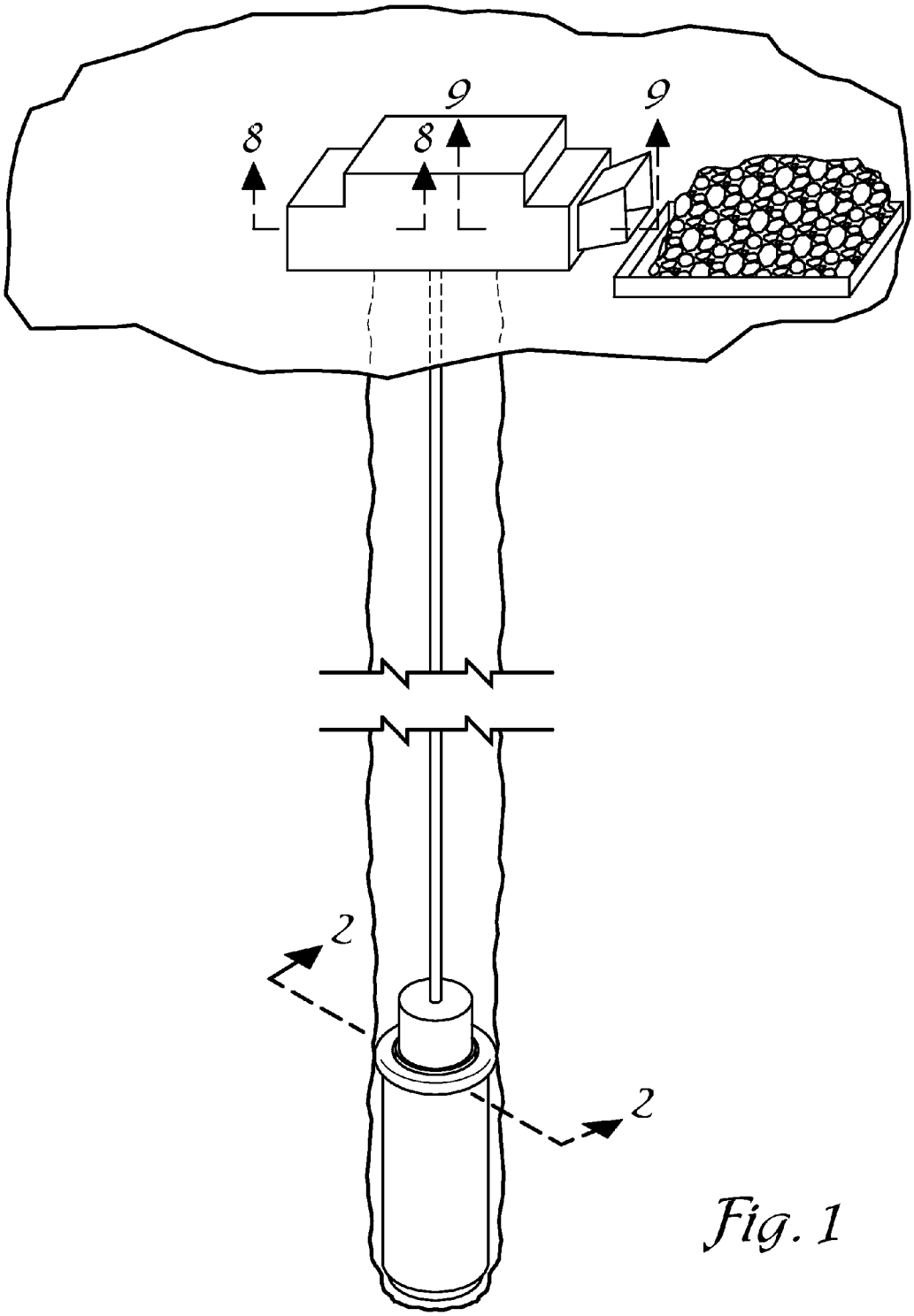
FIG. 1 is a perspective view of a system for performing deep drillings according to the present invention, the system containing a robotic multifunctional underground drilling platform.
Figure 2:
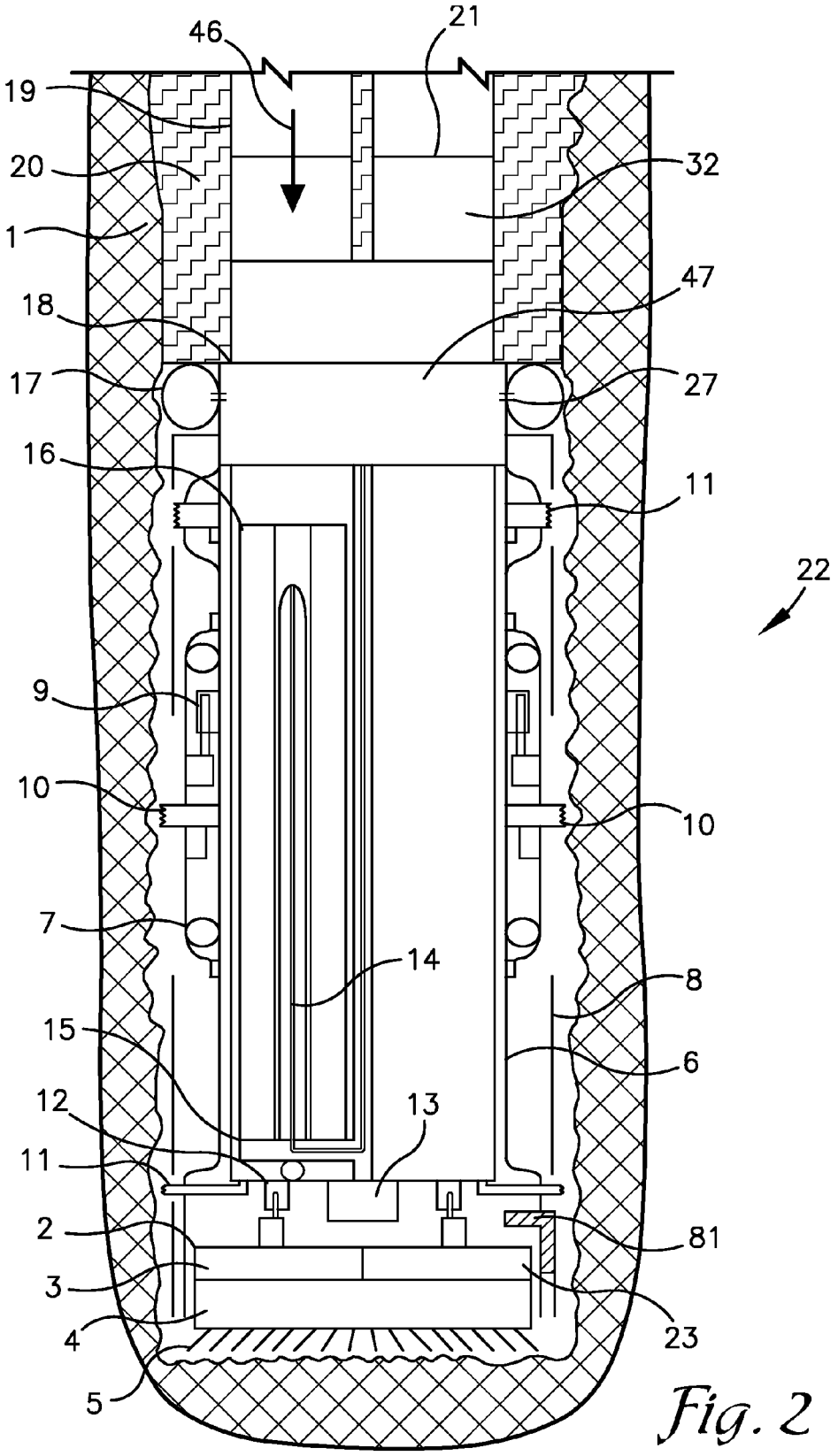
FIG. 2 is an elevational cutaway view of the robotic drilling platform with a transport container.

FIG. 1 shows a system for performing deep drillings with a robotic multifunctional underground drilling platform according to the present invention. The essential parts of the system are shown so that the structures of the respective functional subsystems and their cooperation should be evident.

The mechanism (2) for crushing rock (1) can be modified in a modular way for various crushing technologies (electrical discharge, spallation and the like). The rock crushing mechanism (2) includes rock crushing component (3) having moving action members (5), which crush the rock. The rock crushing component (3) may also have electrodes or jets and the like, an energy subsystem (4) or a part of an energy subsystem, a part of the control electronics (68), and actuators and sensors (23). The rock crushing mechanism (2) is moved relative to the basic jacket (6) by a shifting mechanism (12) which imparts fine movement of the rock crushing mechanism (2). This whole process takes place under water, which fills in the whole borehole.

The whole underground platform (22) moves, the base of the platform (22) being formed by the basic jacket (6). The underground platform (22) shifts relative to rock (1) by means of movement mechanism (7) which moves and directs the platform. The movement mechanism (7) includes a movement actuator (9) and a support spacer (10) as a support mechanism for shifting the whole system. The movement mechanism (7) shifts the device by alternating activation of the movement actuators (9), support spacers (10) and auxiliary spacers (11). The whole unit may also be moved by various values of shift of the movement actuators (9).

The movement mechanism (7) moves and directs the platform by activating auxiliary spacers (11) and movement actuators (9), and gets to its starting position for repeatedly shifting the basic jacket (6) relative to rock (1). The outer protecting sheath (8) forms protection of the rock crushing mechanism (2) against pollution and crushed rock.

The third substantial function of the underground platform (22) is continuous formation of casing from cement composite mixture, which is reinforced by steel, carbon, Kevlar fibers, and the like of various lengths.

Forming the casing is separated from the space of the rock crushing mechanism (2) of rock crushing and movement mechanism (7) by the bottom (18) of the casing formwork. Forming of the casing comprises steel curve pieces (19) of various shapes mutually connected by a flexible joint (21). These parts determine the shape of casing (20) of cement composite mixture. The casing thus creates a system of transport pipes (32).

An important part of forming the casing is the sealing step (17). That is, a sealing must be formed against the surrounding rock, with the cement composite mixture filled against the rock (1). This sealing against the surrounding rock is done via an expandable torus made of composite of metal (carbon, Kevlar) textiles pressurized by power water with controlled pressure through a power water inlet (27).

The fourth function of the underground robotic platform (22) is the braking and manipulation platform (15), the base of which includes a rotary actuator (13) and a braking device (14) of the transport container (16), which is transported through transport piping (32) via circulating water (46) from the surface. The protection against vibrations and pressure waves is realized by a partially open space in which is present gas forming an elastic absorption medium.

Figure 3A:
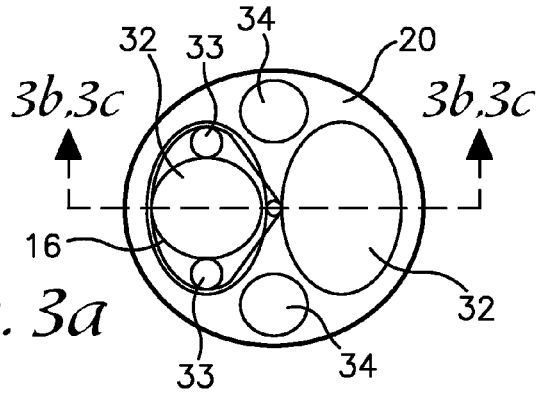
FIG. 3*a* is a top down cross section of a casing profile of the present invention.

FIGS. 2 and 3*a-c* show in detail manipulation of transport containers (16). FIG. 3*a* shows a top down view of a preferred embodiment of casing (20) of cement composite mixture with two openings for transport pipes (32) and two openings for service pipes (34). In one transport pipe (32) a sectional view of transport container (16) with two brake cylinders (33) is shown, which serve as a part of a hydraulic shock absorber.

Figure 3B:
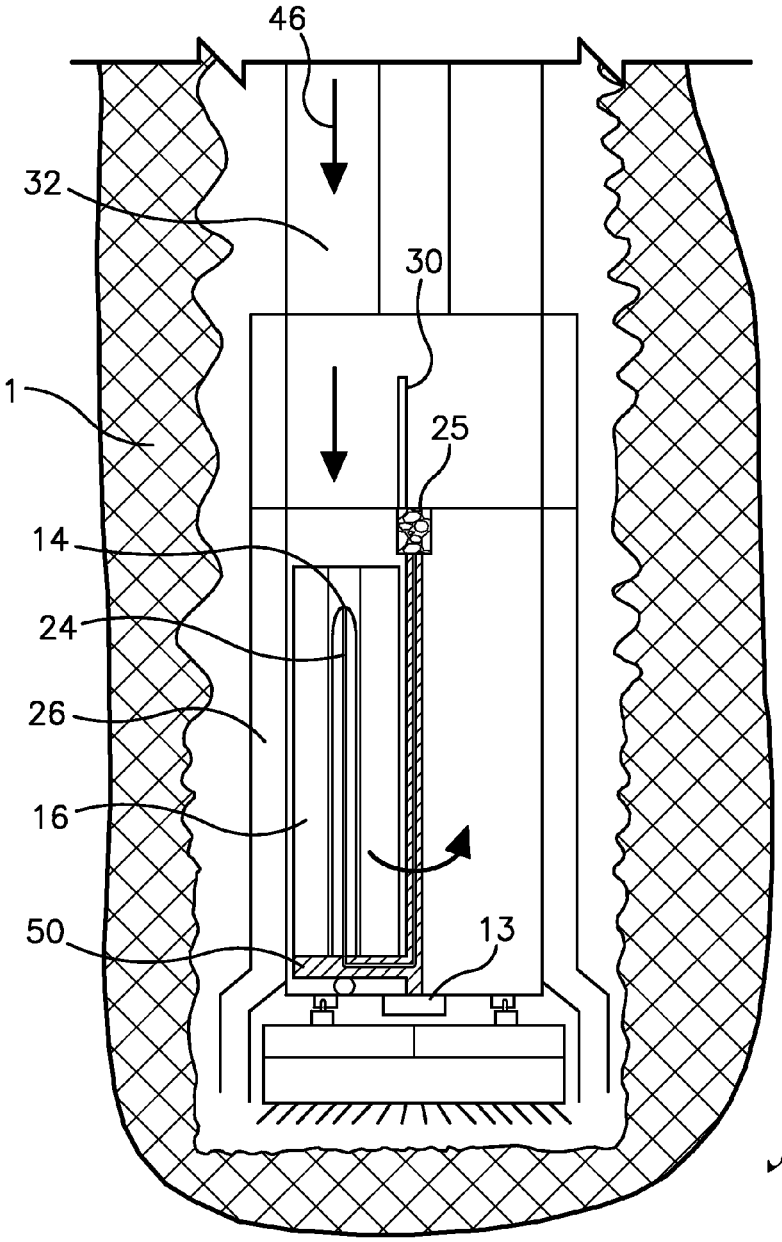
FIG. 3*b* is an elevational cutaway view of the robotic drilling platform of FIG. 2 with the transport container in another position.

FIG. 3*b* shows a preferred embodiment of the invention in more detail from the point of view of manipulation of the transport containers (16). A transport container (16) has come by means of transport pipe (32) from the surface into the space of underground robotic platform (22). The braking device (14) of the transport container (16) brakes the transport container (16) to rest from the original speed of circulating water (46) in transport pipe (32).

The braking effect is achieved by braking piston (24) entering into the braking cylinder (33), which is a part of the transport container (16), and by a narrow profile of forcing water out of the braking cylinder (33). Braking piston (24) is located on the rotary platform (50) and driven by the rotary actuator (13).

Figure 3C:
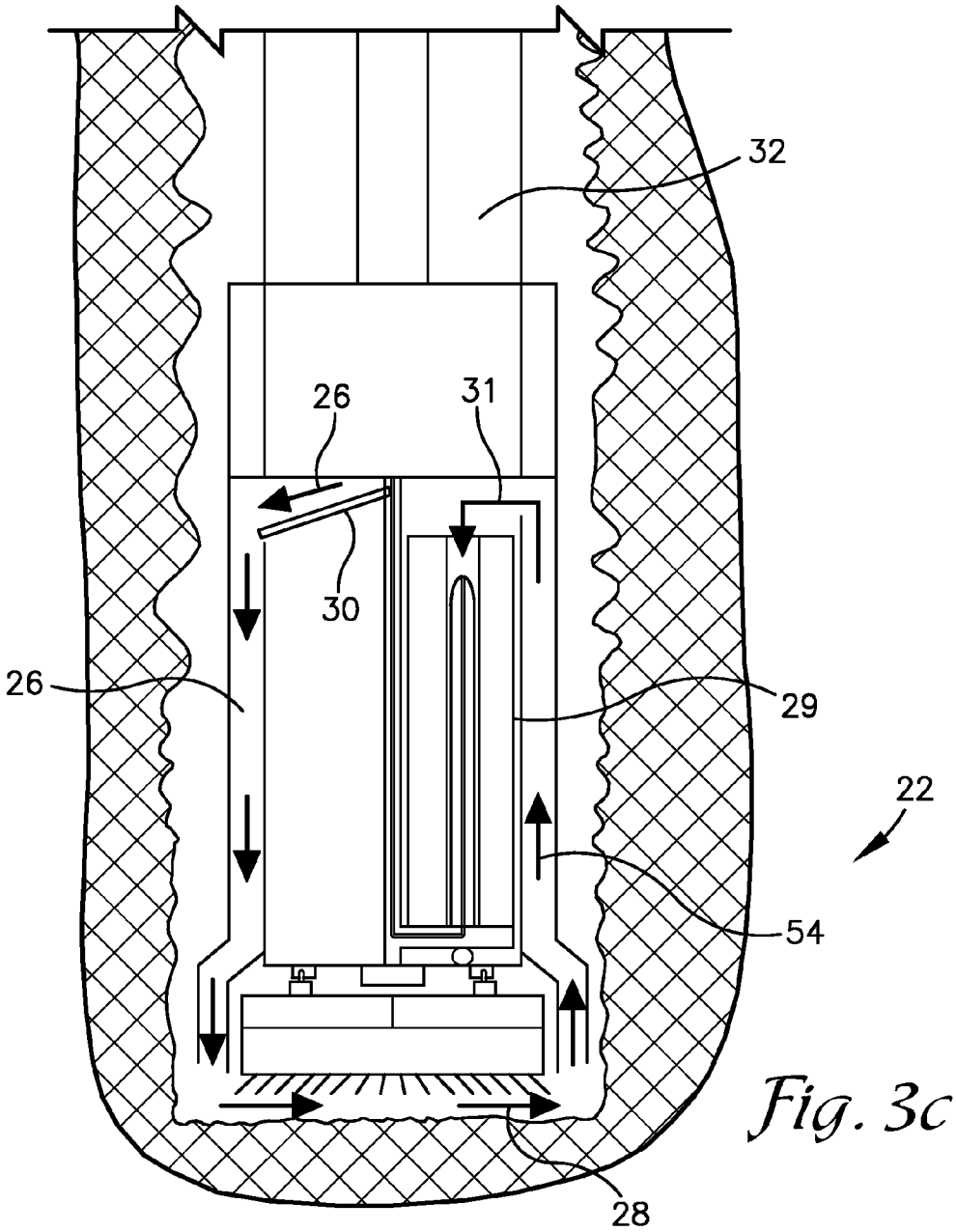
FIG. 3*c* is an elevational cutaway view of the robotic drilling platform of FIG. 3*b* showing the direction of water travel.

FIG. 3*c* shows a preferred embodiment of the invention in more detail from the point of view of manipulation with the transport container (16), which is being rotated by 180° into the position of re-injecting the transport container (16) into circulating water (46) that is headed to the surface through transport pipe (32) after loading crushed rock (1) in rock loading space (31) through flushing path (54).

Circulating water (46) coming through the transport pipe (32) from the surface is directed by a system of flaps (30) for flushing the rock into channel (26) and through the flushing space (28). The circulating water (46) is mixed with crushed rock (1) and conveyed to the rock loading space (29), where a cyclone separation effect in which the tangential movement of the mixture of circulating water (46) with rock (1) is utilized. The coarse fractions of rock (1) settle in the transport container (16) and circulating water (46) with the smallest fractions of rock (1) leaving through the transport pipe (32) to the surface.

After completing the flushing and loading, the transport container (16) is injected into the water circuit in transport pipe (32) by means of injecting power water into the space between the braking piston (24) and the braking cylinder (33). Due to the hydraulic press effect, the transport container (16) starts to move until it is caught by circulating water (46) in the transport pipe (32).

Figure 4A:
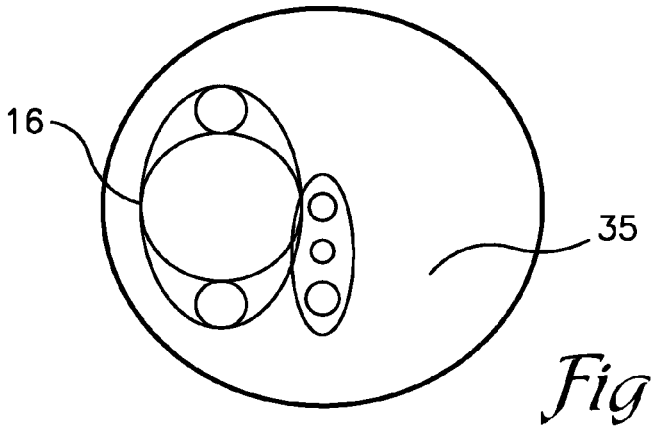
FIG. 4*a* is a top down cross section view of a service subsystem.
Figure 4B:
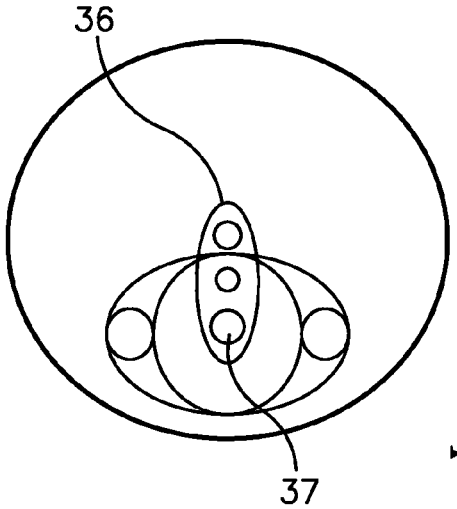
FIG. 4*b* is another top down cross section view of the service subsystem of FIG. 4*a;*
Figure 4C:
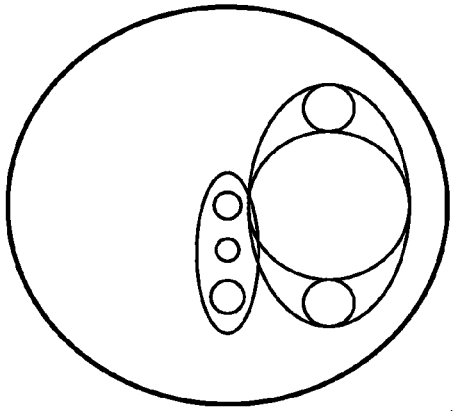
FIG. 4*c* is another top down cross section view of the service subsystem of FIG. 4*a;*

FIGS. 4*a-c* show in more detail phases of manipulating the transport container (16) into different positions in the opening (35) in the rock. In the first position concentric with transport pipe (32), the incoming circulating water (46) brakes the transport container (16) and settles it down on the rotary platform (50), while connections to pressure media are established.

In the second position, the transport container (16) is rotated 90° and is connected with the inlet (25) of connecting module (36) for transporting cement composite mixture. The valve (37) of connecting module (36) is opened for distributing the cement composite mixture into the transport container (16). The cement composite mixture is then injected into the space (47) for formation of the casing. After emptying the transport container (16) of cement composite mixture, the transport container (16) is conveyed to departure position 180° from the starting position.

Figure 5A:
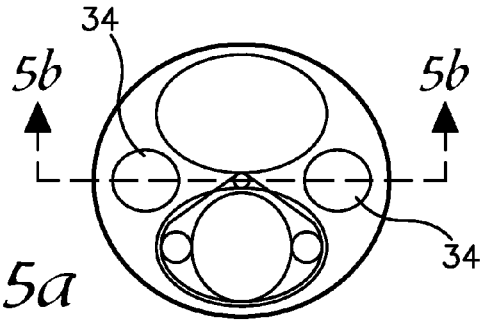
FIG. 5*a* is another top down cross section view of the service subsystem of FIG. 4*a;*
Figure 5B:
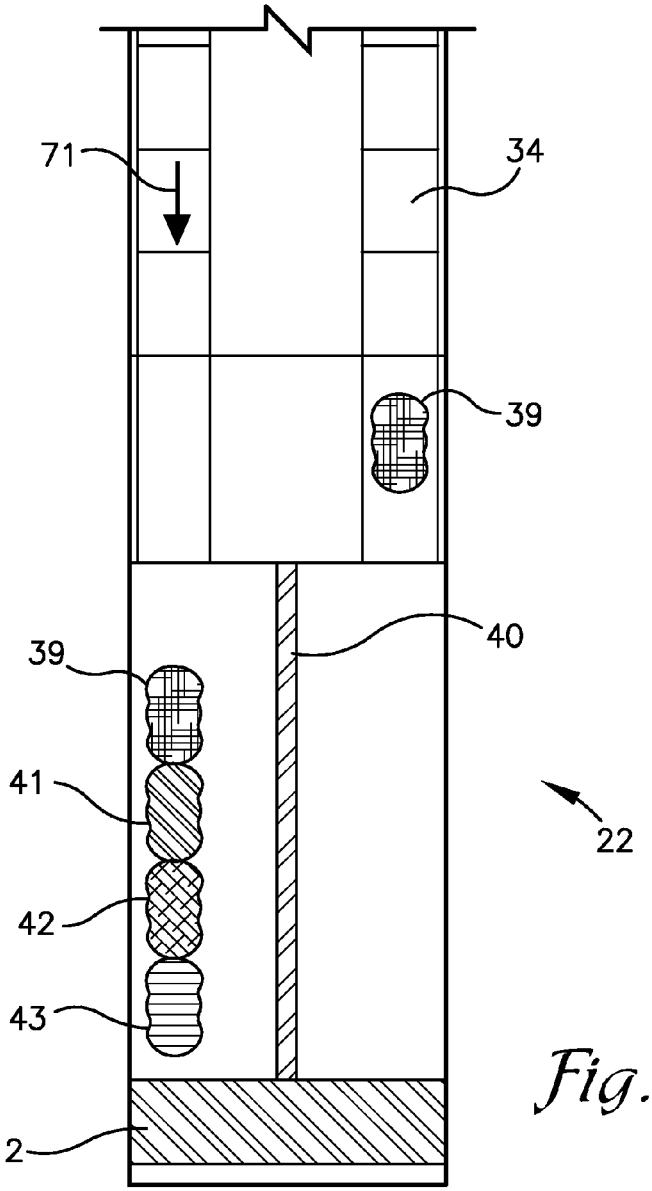
FIG. 5*b* is an elevational cutaway view of the service subsystem of FIG. 5*a;*

FIGS. 5*a,b* describe the service system for providing for and for performing functions of underground robotic platform (22) in more detail. FIG. 5*a* shows a top down section through the formed casing, and FIG. 5*b* shows the system of service functions by means of section 5*b*-5*b*.

Water, which is used for cooling of aggregates, for production of electric, hydraulic energy and the like, flows through a pair of service pipes (34). In the profile which follows after service pipes (34) is where aggregates such as a box of the control and communication block (39), miniature turbine (41), generator (42) of electric energy, and hydraulic pump (43) for high-pressure media for controlling and driving hydraulic elements are located. A part of the service system also includes channel (40) for service signals and energy and for passage of some of the service water (71). The system of service functions is connected also to block (2) of rock crushing, which is interconnected with boxes of the control and communication block (39) and also with service water (71).

Figure 6A:
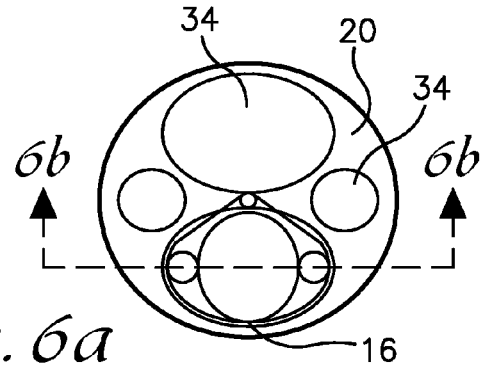
FIG. 6*a* is another top down cross section view of the service subsystem of FIG. 4*a;*
Figure 6B:
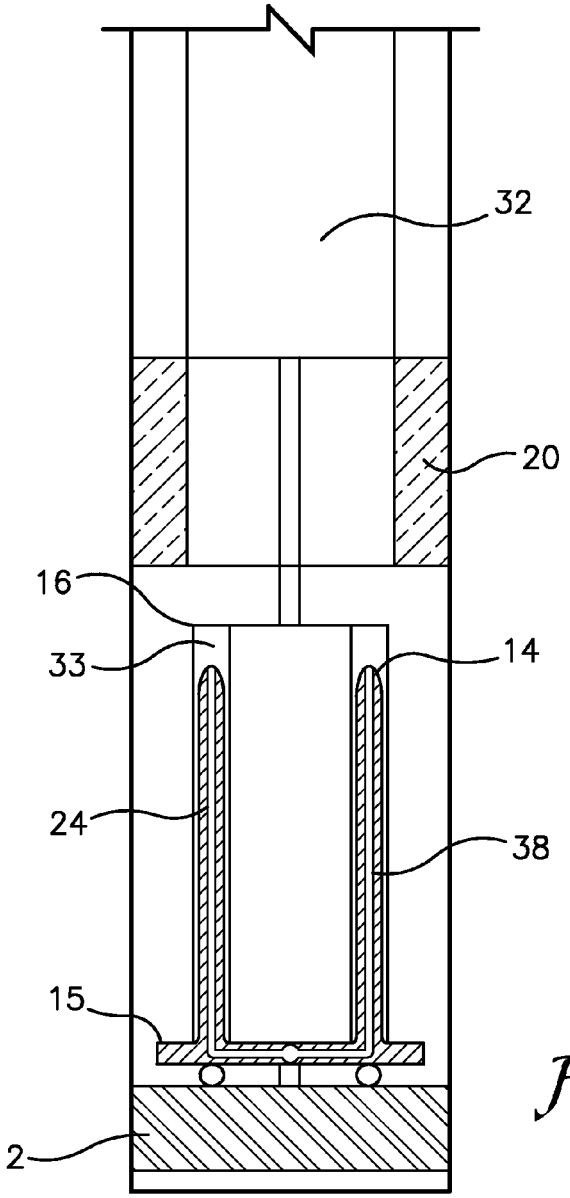
FIG. 6*b* is an elevational cutaway view of the service subsystem of FIG. 6*a;*

FIG. 6*a* shows a top down view through casing (20) of cement composite mixture with two transport pipes (32) and two service pipes (34) and with a section through transport container (16) shown in the profile of transport pipe (32). FIG. 6*b* shows in a detail the section 6*a*-6*a* of the transport container (16), casing (20) of cement composite mixture and transport pipe (32). FIG. 6*b* further shows braking device (14) with braking piston (24) and braking cylinder (33). The transport container (16) rests on the braking and manipulation platform (15). Exit (ejection) pressure pipe (38) serves to feed power water into the space between braking piston (24) and braking cylinder (33).

Figure 7A:
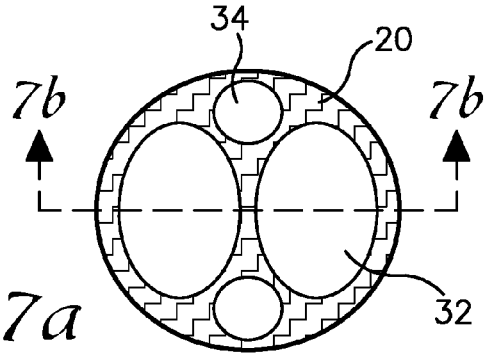
FIG. 7*a* is a top down cross section view of a transport infrastructure.
Figure 7B:
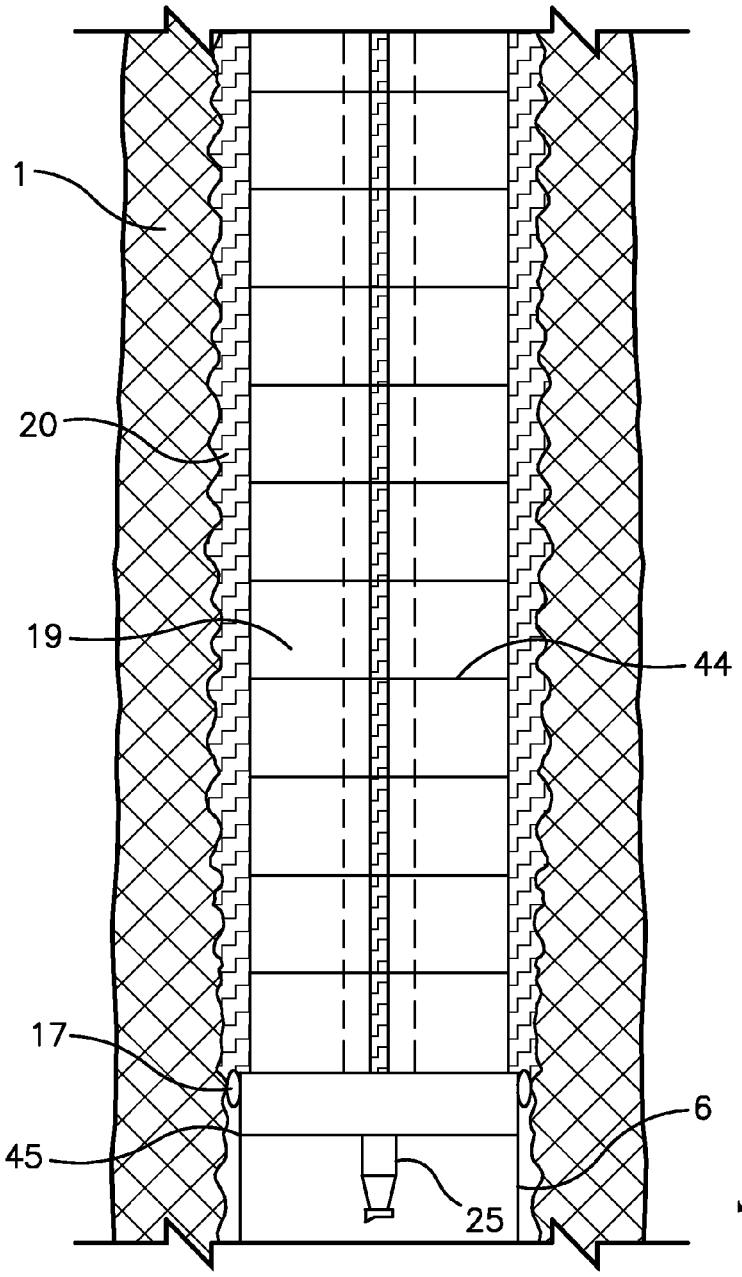
FIG. 7*b* is an elevational cutaway view of the transport infrastructure of FIG. 7*a;*

FIG. 7*a* shows a section through the continuous casing (20) of cement composite mixture containing four openings, two for transport pipes (32) and two for service pipes (34). In section 7*b*-7*b* in FIG. 7*b*, system of continuously forming the casing (20) of cement composite mixture is shown. From the basic jacket (6) of the system, over the bottom (45) of the formwork of cement composite mixture, there continues the space (47), into which the cement composite mixture is injected under pressure through the connection inlet (25) when the container (16) is connected to the inlet (25). The sealing (17) against the surrounding rock serves to seal the space over the bottom (45) of the formwork. The sealing (17) against the surrounding rock is realized by a material having a torus shape, the sealing being pressurized by power water through inlet (27). The torus shape assumes an irregular surface shape during the drilling process. The torus may be made of various elastic materials resistant against high temperatures of 400° C. and high pressures up to 1000 bar and resistant against abrasion. Connected to the body of the basic jacket (6) is a system of curve pieces (19) of the formwork, which are joined to each other by elastic joints (44). The first curve piece (19) of the formwork is connected with the basic jacket (6) and together they are gradually axially pulled out of the wet cement composite mixture, as required by technological parameters of the cement composite mixture setting. The number of curve pieces (19) of the formwork and their unit length are given by parameters of the cement composite mixture setting.

Figure 8:
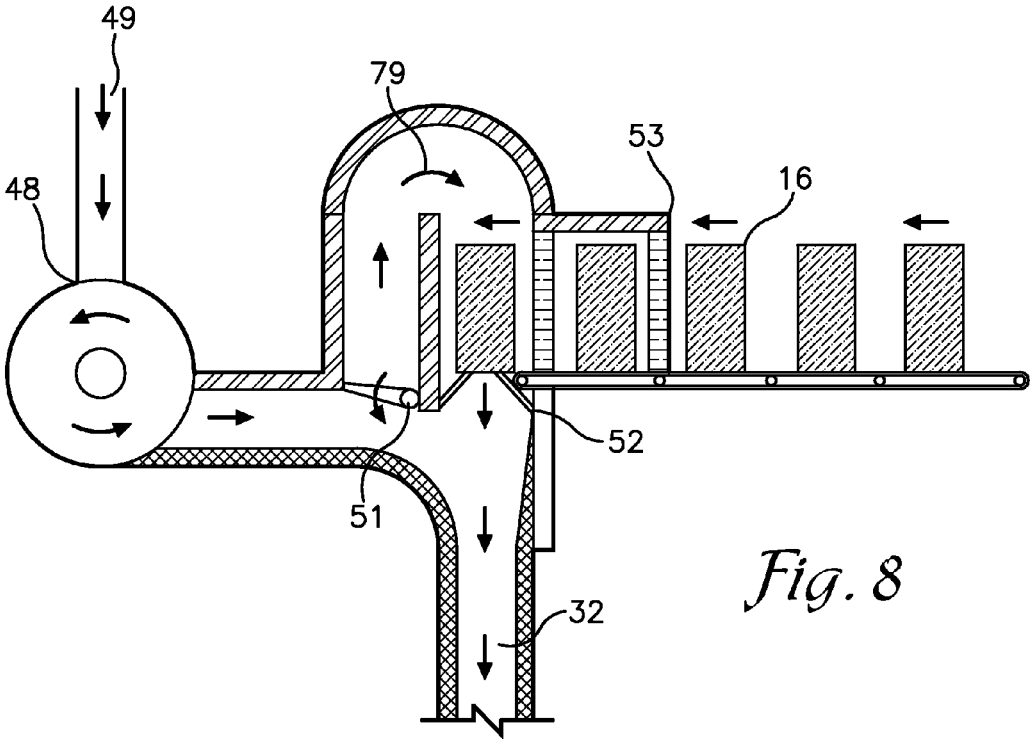
FIG. 8 is an elevational cross section view of injection of containers into the transport subsystem.

FIG. 8 shows a preferred embodiment of a subsystem of injecting transport containers (16) into the transport pipe (32). In a steady-state regime, water from the decanting plant (49) is led through the water pump (48) into the transport pipe (32), through which it is directed under the surface to the drilling underground robotic platform (22).

System of flaps (51) may redirect water from the decanting plant (49) to transport containers (16) for injecting containers.

The surge chamber (53) for injecting containers serves for isolating the high-pressure environment from the outer environment. Simultaneously with redirecting the system of flaps (51) for injecting containers and system of flaps (52) for releasing a container in the cycle of transport containers (16), most of the water volume moves through water route (79) over the container and pushes it into the transport pipe (32). This action is repeated with the next transport container. It is obvious that acting of system of flaps (51) for injecting containers and system of flaps (52) for releasing a container must be synchronized to maintain the total water volume flowing into the transport pipe (32) constant.

Figure 9:
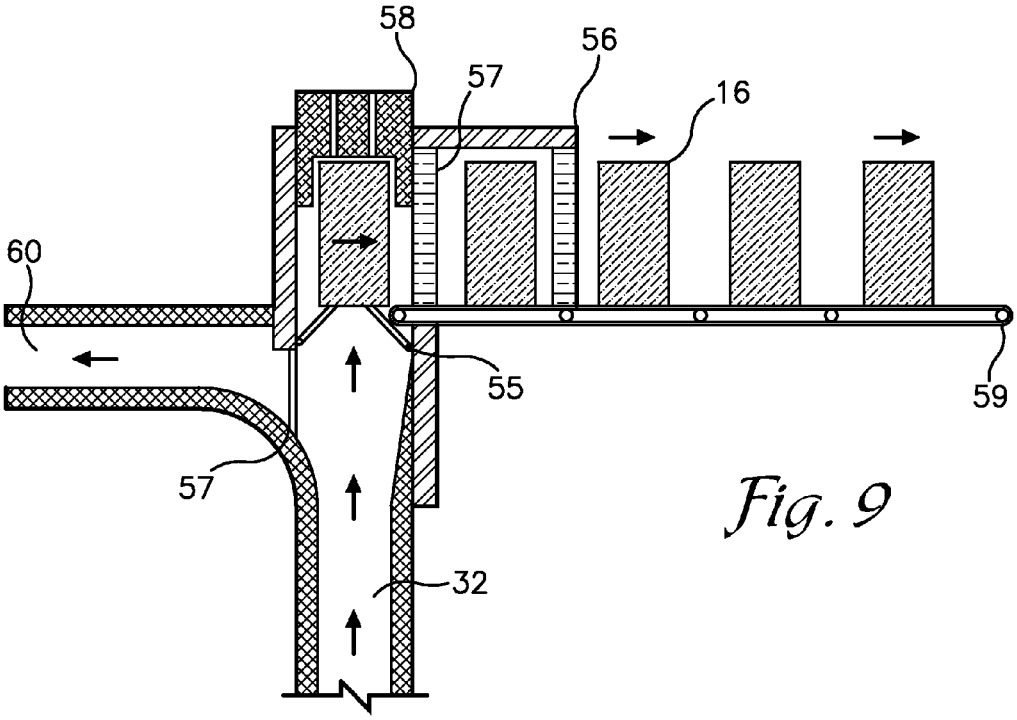
FIG. 9 is an elevational cross section view of exit of containers from the transport subsystem.

FIG. 9 shows a preferred embodiment of exit of transport containers (16) from the system. Returned water in the steady-state regime flows from the transport pipe (32) to the exit (60) to decanting plant for recycling. An exiting transport container (16) is led directly through the system (57) of grids into the damping structure (58), where it is captured by means of system of flaps (55) for capturing a container and subsequently directed through the surge chamber (56) for exit (ejection) of containers onto transporter (59) of containers and materials.

Figure 10A:
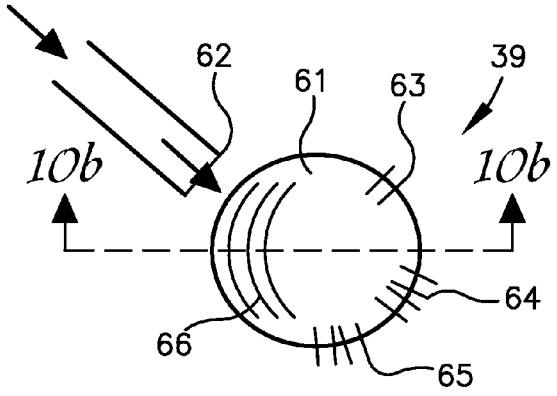
FIG. 10*a* is a top down view of a control and communication device.
Figure 10B:
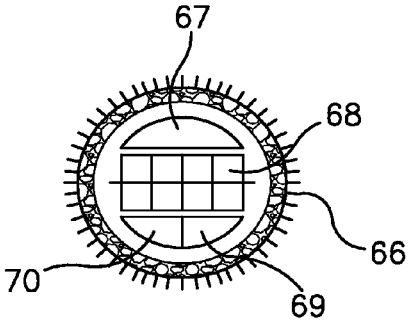
FIG. 10*b* is an elevational cutaway view of the control and communication device of FIG. 10*a;*
Figure 10C:
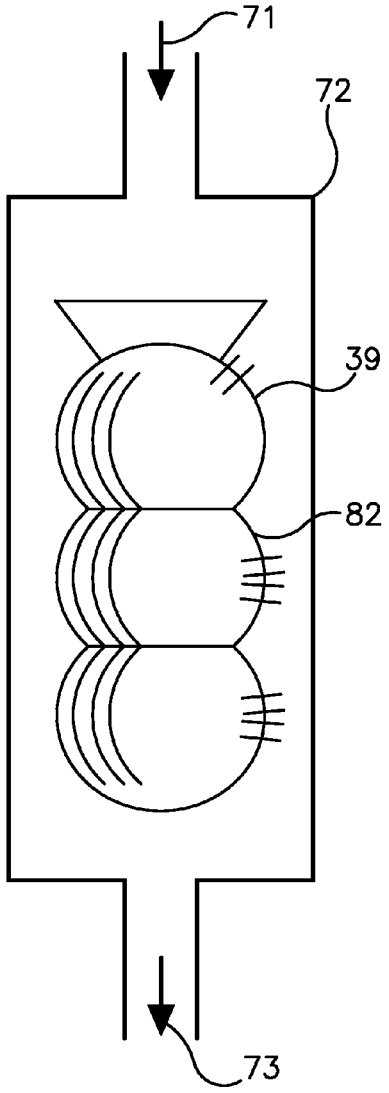
FIG. 10*c* is an elevational view of another control and communication device.

FIG. 10*a*-*c* shows a preferred embodiment of the control and communication box (39). The control and communication box (39) is resistant against high pressure of more than 1000 bar, having an optimum shape (sphere) for the ratio volume/surface/pressure, and being intensively cooled by service water (71) from the outside and by an inner cooling system (70) from the inside.

FIG. 10*a* shows a particular embodiment of the control and communication box (39), where box (61) is resistant against water and pressure is equipped from the outside of spherical surface by ribbing (66), to which cooling water (62) is fed. Further, electric energy is fed through an electric energy supply (63) in special high-pressure transition pieces (64), hydraulic energy is fed through a hydraulic energy supply (65), and signals are carried through special high-pressure transition pieces (64).

FIG. 10*b* shows section 10*b*-10*b* from FIG. 10*a*, which shows the inner structure of the control and communication box (39), including a part (67) for input-output signals, control electronics (68), an inner cooling system (70), and external cooling ribbing (66). The box further contains an electric supply (69).

FIG. 10*c* shows a preferred embodiment of the control and communication box (39) of a larger volume in the form of several spherical parts mutually interconnected in one hermetic unit. This multi-box (82) is received in a packing forming a service channel (72) through which flows service water (71) and exits return water (73).

Figure 11A:
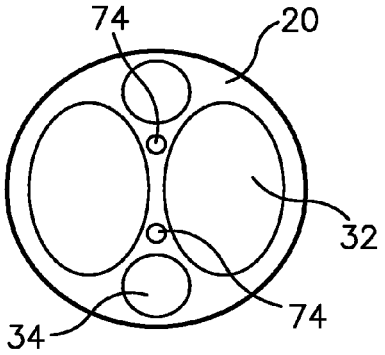
FIG. 11*a* is a top down cross section view of the service system of FIG. 4*a;*

FIGS. 11*a,b* show a preferred embodiment of the invention, where the method of continuous forming of casing (20) of cement composite mixture simultaneously forms openings in casing (20) of cement composite mixture, thereby expanding the openings automatically with the drilling process, as described below.

This advantageous property can be utilized for example in the case of rock crushing mechanism (2) based on the supply of liquid or gaseous fuels (for example hydrothermal cleavage-spallation).

FIG. 11*a* shows a section through casing (20) of cement composite mixture, where several pipes (74) of fuel supply are realized besides transport pipe (32) and service pipe (34). There may be several pipes (74) of fuel supply for various fuel components and also reserve pipes for the case of failure or clogging.

Figure 11B:
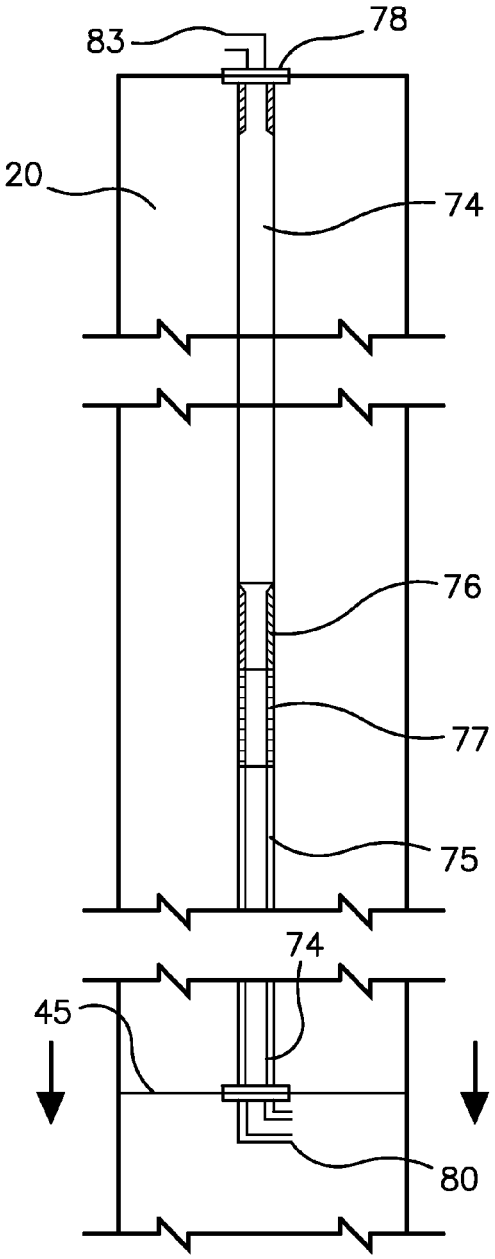
FIG. 11*b* is an elevational view of the service system of FIG. 11*a*.

FIG. 11*b* shows a part of the moving formwork (75) of fuel supply in the form of a metal tube terminating with several seals, for example by a labyrinth seal (77), sliding elastic seal (76), such that an opening in the casing pipe (74) of fuel supply is realized.

FIG. 11*b* further shows inlet (83) of fuel into the fuel piping in the casing by firm attachment of the fuel supply system (78) at the surface. The fuel piping is also firmly attached to the rock crushing device (2) at the borehole bottom at the underground robotic platform (22).

Figure 12:
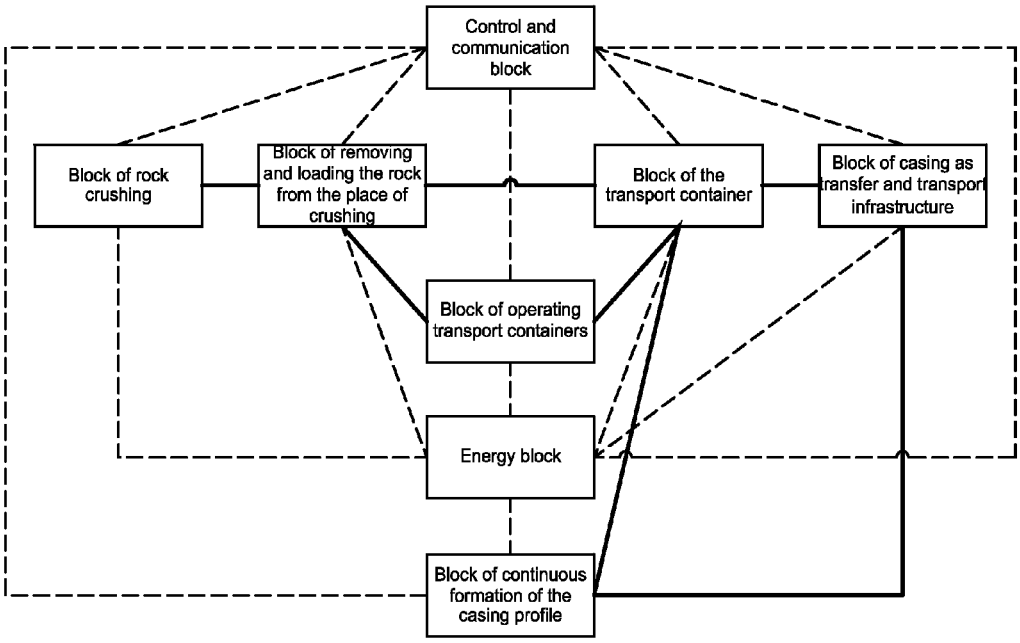
FIG. 12 is a schematic of subsystems of the drilling system and their relations.

FIG. 12 shows the subsystems and other features of the drilling system and their relations.

INDUSTRIAL APPLICABILITY

The present invention may be utilized in the field of geothermal drillings, oil wells and gassers, mining wells, ore veins, and tunneling. The invention is profitable mainly in rock crushing in aqueous environment at high pressures and temperatures.

The invention claimed is:

1. A system for performing deep drillings in geological formations, the system having a surface base and adapted for creating a borehole in a geological formation which is adapted to be filled with fluid, the system comprising a robotic multi-functional underground drilling platform including: a component for crushing rock, a component for continuous formation of casing profile, a component of casing as transfer and transport infrastructure, a transport container component, a control and communication component, an energy component, a component of operating transport containers, and a component of removing and loading the rock from the place of crushing, wherein the component for crushing rock is interconnected with the component of removing and loading the rock from the place of crushing by means of water channels, wherein the component of removing and loading the rock from the place of crushing is interconnected with transport container component by means of water channels, wherein the component of casing as transfer and transport infrastructure is connected to the component for continuous forming of casing profile by means of moving formworks, wherein the component of operating transport containers is connected to the transport container component by means of operating mechanics, wherein the component of removing and loading the rock from the place of crushing is interconnected with the component of operating transport containers by means of water channels, wherein the component of operating transport containers is interconnected with the transport container component by means of water channels, wherein the transport container component is interconnected with the component for continuous forming of the casing profile by means of injection channels, wherein the transport container component is interconnected with the component of casing transfer and transport infrastructure by means of water channels, wherein the control and communication component is connected to the other components by sensory channels and channels of control signals, and wherein the energy component is interconnected with the other components by energetic channels.

2. A system for performing deep drillings according to claim 1, wherein; the robotic multi-functional underground drilling platform is supplemented with at least one of the following components:

a) a component for moving and directing the platform, b) a component for fine moving of the rock crushing component, c) a component for connecting the multi-functional underground drilling platform to a container of cement composite mixture, d) a component for injecting containers at the surface, e) a component for exit or ejecting of containers at the surface, f) a component including a braking device for braking a container in a transport pipe, with quick braking effect on the transport component in the transport pipe, g) a component for sealing against the surrounding rock, and h) a component for protection against vibrations and pressure wave.

3. A system for performing deep drillings according to claim 2, wherein the component for sealing against the surrounding rock includes an elastic, water pressurized torus made of a textile selected from the group consisting of textiles having metal fibers, Kevlar, carbon fibers, or a mixture thereof.

4. A system for performing deep drillings according to claim 2, wherein the component for protection against vibrations and pressure wave is selected from the group consisting of components formed by a covering containing granulate, a covering of a perforated metal plate, suitably shaped baffle areas, channels for leading away the pressure wave, partially open gas containers and the like, or any combination thereof.

5. A system for performing deep drillings according to claim 2, wherein the component for connecting the multi-functional underground drilling platform to the container of cement composite mixture includes at least one connection to a high-pressure hydraulic medium.

6. A system for performing deep drillings according to claim 2, wherein the component for injecting containers at the surface includes water from the decanting plant, a pump, a system of flaps for injecting containers, a surge chamber for injecting containers, a system of flaps for releasing a container, and a water route over the container.

7. A system for performing deep drillings according to claim 2, wherein the component for exit or ejecting of containers at the surface includes an exit to a decanting plant, a system of grids, a damping structure, a system of flaps for capturing a container, a surge chamber for exit or ejecting of containers, and a transporter of containers and material.

8. A system for performing deep drillings according to claim 1, wherein the component for continuous forming of casing profile includes a bottom of the formwork, a curved piece of the formwork, a flexible joint, a bottom of the formwork of cement composite mixture, a space of casing forming, a component for connecting to a container of cement composite mixture, and elastic joints of curve pieces.

9. A system for performing deep drillings according to claim 1, wherein the casing component as transfer and transport infrastructure comprises a transport pipe, a casing of cement composite mixture, a service pipe, a channel for service signals and energy, service water, a pipe of fuel supply, a moving formwork of fuel supply, a labyrinth seal, a sliding elastic seal, an inlet of fuel into the fuel piping, a fuel supply system at the surface, an attachment of the underground fuel supply system, and wherein a lower, deeper part of the casing made of the cement composite mixture has a considerably higher thermal conductivity than an upper part of the casing made of the cement composite mixture, and wherein the moving formwork of the fuel supply includes a sealing between the formwork of fuel supply and formed casing.

10. A system for performing deep drillings according to claim 1, wherein the component of operating transport containers includes a braking and manipulation platform, a rotary actuator, a braking device, a braking cylinder, a braking piston, and a rotary platform.

11. A system for performing deep drillings according to claim 1, wherein the component of removing and loading the rock from the place of crushing includes circulating water, a space of rock loading, a flushing path, a system of flaps for flushing the rock out, a channel for flushing, a space of flushing, and a space of rock loading.

12. A system for performing deep drillings according to claim 1, wherein the transport container component is equipped with a braking device for braking a container at the bottom of the borehole and also with a braking device for braking a container in a transport pipe, and wherein the transport container component includes a cyclone separator for separating water from the crushed rock, an energetic carrier, or a hydraulic piston and/or interface node for connecting with the robotic multi-functional underground drilling platform for conveying the cement composite mixture, a mixture of water with the rock, a pressure hydraulic medium, or an energetic carrier.

13. A system for performing deep drillings according to claim 1, wherein the control and communication component is protected by a hermetic box resistant against high pressure of water and with the box surface able to dissipate the heat from the control and communication component into the surrounding environment.

14. A method of performing deep drillings in geological formations, the method comprising the following steps:

a. crushing or disintegrating rock in a component of rock crushing, wherein the rock is crushed or disintegrated by means of one or a combination of devices of a group of devices utilized for rock crushing by performing directed explosion, electro-spark discharge, water beam, plasma process, laser spallation, plasma spallation, high-temperature fluidics, and mechanical means, b. filling a moving formwork in a component for continuous formation of a casing profile by filling the moving formwork from a container with cement composition reinforced with reinforcing materials selected from the group consisting of metal fibers, carbon fibers, Kevlar fibers, or their mixture with various fiber lengths, which cement composition after solidifying forms the casing, and wherein the component for continuous formation of a casing continuously forms the casing by the moving formwork, ensures interaction of the moving formwork with the formed casing, and continuously forms at least 2 openings, c. providing a downward water transport path and an upward water transport path in a component of casing as transfer and transport infrastructure, which component is formed during the drilling process, by the two openings made in the casing, wherein the transport paths are provided for container transport from a surface to a bottom of a borehole and back, based on the forces of circulating water or/and based on the container buoyancy, either positive or negative, based on the gas buoyancy (airlift), and by further openings, the cement composite mixture being formed between the individual openings, the cement composite mixture being formed between the individual openings as reinforcement of the whole casing, the casing further including further openings for transport of water for cooling and transport of water power, openings for transport of liquid or gaseous energy carriers, electric energy, and signals, and wherein the component of casing as transfer and transport infrastructure cooperates with the component for rock crushing and the component for continuous formation of casing profile, d. transporting materials by a transport container component to the surface and/or of specialized devices, e. controlling the rock crushing component, the component for continuous formation of a casing profile, the component of casing as transfer and transport infrastructure, and the transport container component via a control and communication component by performing telemetry, signaling, acquiring and evaluation of sensory information, f. transforming energy from primary energy to energy forms for the respective rock crushing component, component for continuous formation of a casing profile, component of casing as transfer and transport infrastructure, and control and communication component of the platform, g. providing a component for operating transport containers for positioning the transport containers into functional positions, and h. providing a component for removing and loading the rock from a place of crushing, wherein rock is removed and loaded hydrodynamically.

15. A method of performing deep drillings according to claim 14, the method further comprising the following steps:

a. providing a component for fine moving of the component of rock crushing which ensures movement in dependence on the progress of rock crushing, b. filling the moving framework in the component of continuous formation of the casing profile from a container by a cement composition which is lighter than water, c. providing a source of transport and supply of fuels and oxidizers in the component of casing as transfer and transport infrastructure including pipes for transport of liquid or gaseous fuels through the openings, which pipes are expanded at the bottom of the borehole for transporting fuels and oxidizers to the place of their use and to the rock crushing component, d. performing, in the transport container component, the separation of water from crushed rock and/or the injection of cement composition into a space for casing forming and/or the connection with the platform for transportation of the cement composite mixture or mixture of water with the rock or the pressurization of hydraulic media or energy carrier, e. cooling the control and communication component with the medium from pipe in the casing, and wherein the control and communication component is connected to the surface by means of conducting electric cables and/or in a wireless manner, f. converting, at the energy component, energy from power water supplied from above to driving power for the respective platform locks, electric energy fed by an electric cable through casing pipe, an autonomous source, energy of crushing explosion, hydraulic medium and a solid or liquid carrier, g. transforming, at the energy component, supplied electric low voltage energy to high voltage energy, and wherein the energy component is protected by a hermetic box resistant against high pressure, h. providing a component for moving and directing the platform, wherein directing and shifting the platform is provided by actuators relative to the surrounding rock in at least three points, and directing and shifting of rock crushing processes in cooperation with the control and communication component, and where the component of moving the platform provides the platform movement in dependence on the process of casing solidification, on the process of rock crushing, controlled by the control and communication component in dependence on the particular platform processes, i. providing a component for connection to the container for injection of cement composite mixture, which, after solidification, forms the casing, and ensures connection for transfer of the mixture, and at least one connection to high-pressure hydraulic medium for injecting the mixture, j. providing a braking device component for braking a container in a transport pipe, wherein the braking is activated by pressure change over and under the container, k. providing a component for protection against vibrations and pressure waves which relieves the effects of vibrations and/or pressure waves caused mainly by the rock crushing component, where the functional component for protection against vibrations and pressure waves provides protection of the platform against damage caused by a pressure wave, l. providing a component for injecting containers at the surface, which provides entry of the containers into circulating transport water, m. providing a component for exit or ejection of containers at the surface, which provides for exit of the containers out of circulating transport water, n. wherein the transport container component separates the crushed rock from water by means of a cyclone separator, o. wherein the transport container component, which injects the cement composite into the component for continuous forming of casing profile operates by means of a hydraulic piston, p. providing a component for sealing against the surrounding rock, providing watertight separation of space of the component for continuous forming of casing profile from the surrounding rock, and q. wherein the component for operating transport containers provides for exit or ejection of containers from circulating water at the borehole bottom, injection of containers into circulating water, and starting-up of containers entering the circulating water.

16. A method for performing deep drillings according to claim 14, wherein the borehole is configured for use in geothermal applications.

17. A method for performing deep drillings according to claim 14, wherein the rock is removed and loaded by a water stream and/or a gas stream.

18. A method for performing deep drillings according to claim 14, wherein the material transported to the surface by the transport container component includes cement composite mixture and/or crushed rock.

* * * * *

UNITED STATES PATENT AND TRADEMARK OFFICE

CERTIFICATE OF CORRECTION

PATENT NO. : 8,944,186 B2
APPLICATION NO. : 13/148032
DATED : February 3, 2015
INVENTOR(S) : Igor Kočiš et al.

It is certified that error appears in the above-identified patent and that said Letters Patent is hereby corrected as shown below:

Claims

Column 17, lines 41 - 43, Claim 14, cancel the text "the cement composite mixture being formed between the individual openings,"

Signed and Sealed this
Twenty-ninth Day of December, 2015

Michelle K. Lee

Michelle K. Lee
*Director of the United States Patent and Trademark Office*